US005297884A

United States Patent [19]

Cubillas

[11] Patent Number: 5,297,884

[45] Date of Patent: Mar. 29, 1994

[54] TOOTHBRUSH CLEANING SYSTEM

[76] Inventor: Alberto Cubillas, Box 7, Guaymas, Sonora, Mexico, 85400

[21] Appl. No.: 997,315

[22] Filed: Dec. 28, 1992

[51] Int. Cl.[5] ..... A46B 11/00; A46B 11/06

[52] U.S. Cl. ..... 401/268; 401/287; 401/289; 401/291

[58] Field of Search ..... 401/268, 287, 289, 291

[56] References Cited

U.S. PATENT DOCUMENTS

| | | | |
|---|---|---|---|
| 1,617,569 | 2/1927 | Boyle | 401/291 X |
| 3,135,989 | 6/1964 | Gatti | 401/289 |
| 3,653,778 | 4/1972 | Freiling | 401/287 |
| 4,175,879 | 11/1979 | Molinari | 401/287 |

FOREIGN PATENT DOCUMENTS

| | | | |
|---|---|---|---|
| 3410539 | 10/1985 | Fed. Rep. of Germany | 401/289 |

*Primary Examiner*—Steven A. Bratlie

*Attorney, Agent, or Firm*—Richard L. Miller

[57] ABSTRACT

A toothbrush cleaning system is incorporated within a toothbrush which consists of a system of conduits provided for forcing water from a water faucet to travel through the system to clean toothpaste and debris from bristle tufts of the toothbrush. The force of water is directed from within a bristle head of the toothbrush towards the bases of the bristle tufts where most of the toothpaste and debris accumulate, to properly clean the bristle tufts.

4 Claims, 1 Drawing Sheet

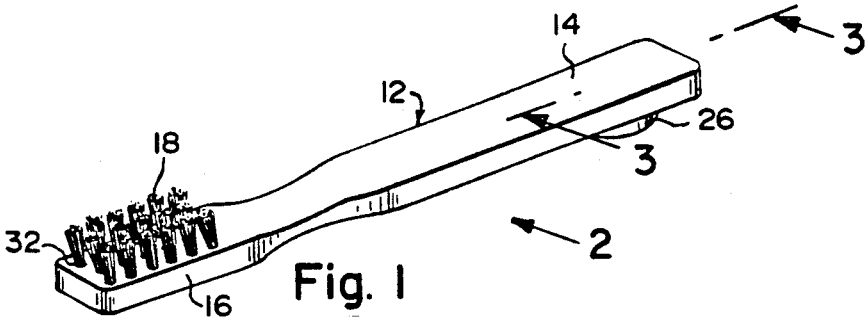
Fig. 1
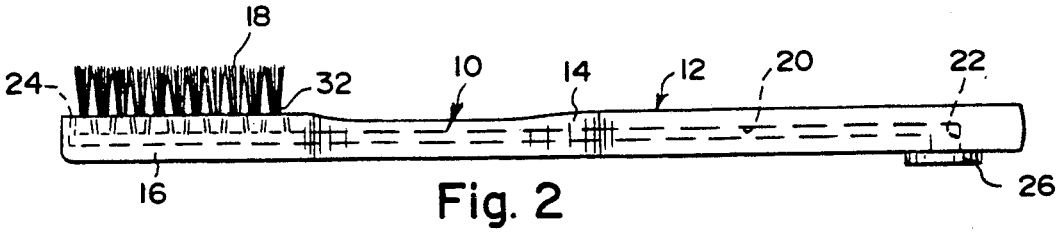
Fig. 2
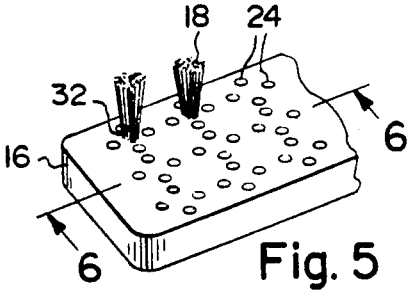
Fig. 5
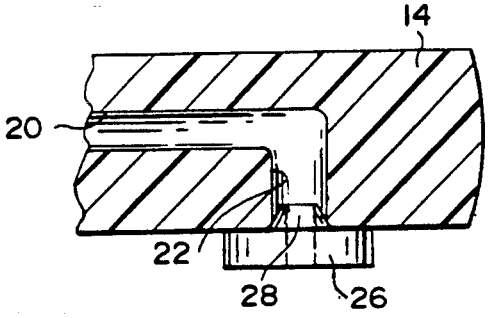
Fig. 3
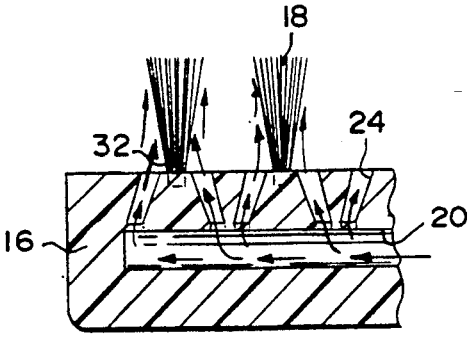
Fig. 6
Fig. 4
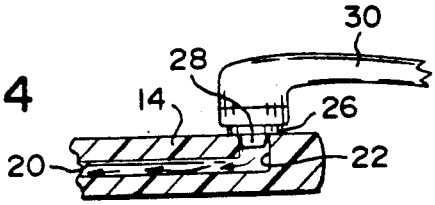

TOOTHBRUSH CLEANING SYSTEM

BACKGROUND OF THE INVENTION

The instant invention relates generally to toothbrush accessories and more specifically it relates to a toothbrush cleaning system.

Numerous toothbrush accessories have been provided in the prior art that are adapted to be used in tooth care to facilitate more effective and convenient care of the teeth and gums. For example, U.S. Pat. Nos. 4,827,551 to Maser et al.; 4,995,509 to Kornfeind and Des. 266,117 to Oberheim all are illustrative of such prior art. While these units may be suitable for the particular purpose to which they address, they would not be as suitable for the purpose of the present invention as hereafter described.

SUMMARY OF THE INVENTION

A primary object of the present invention is to provide a toothbrush cleaning system that will overcome the shortcomings of the prior art devices.

Another object is to provide a toothbrush cleaning system that is built within a toothbrush which utilizes the force of water from a water faucet to clean toothpaste, food particles and debris from the bristle tufts.

An additional object is to provide a toothbrush cleaning system in which the force of water is directed from within the bristle head towards the bases of the bristle tufts, where most of the toothpaste, food particles and debris accumulate, to properly clean the bristle tufts.

A further object is to provide a toothbrush cleaning system that is simple and easy to use.

A still further object is to provide a toothbrush cleaning system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view a toothbrush incorporating the instant invention;

FIG. 2 is an enlarged diagrammatic elevational view taken in the direction of arrow 2 in FIG. 1;

FIG. 3 is an enlarged cross sectional view taken along line 3—3 in FIG. 1;

FIG. 4 is a diagrammatic cross sectional view of a rear portion of the handle illustrating the toothbrush being cleaned;

FIG. 5 is an enlarged diagrammatic perspective view with parts broken away of the head of the toothbrush, showing a portion of the instant invention therein; and FIG. 6 is an enlarged cross sectional view taken along line 6—6 in FIG. 5.

DETAILED DESCRIPTION OF THE PREFERRED EMBODIMENTS

Turning now descriptively to the drawings, in which similar reference characters denote similar elements throughout the several views, the Figures illustrate a toothbrush cleaning system 10 for a toothbrush 12, having a handle 14, a head 16 and a plurality of bristle tufts 18 extending from the head 16. The cleaning system 10 consists of the handle 14 and the head 16 having a longitudinal conduit 20 extending therethrough. The handle 14 has a water inlet port 22 fluidly connected to one end of the conduit 20 on an opposite side of the handle 14 from the bristle tufts 18. The head 16 has a plurality of water outlet ports 24 fluidly connected to an opposite end of the conduit 20, on a same side with the bristle tufts 18. A flexible washer 26 has a tapered neck 28, which extends into the water inlet port 22. The washer 26 can be pressed against a water faucet 30 to form a seal thereabout and allow a force of water from the water faucet 30 to enter the water inlet port 22, travel through the conduit 20 and exit the water outlet ports 24, to clean toothpaste and debris from the bristle tufts 18.

As best seen in FIG. 6, the water outlet ports 24 are angled towards each base 32 of the bristle tufts 18, where most of the toothpaste and debris accumulate. The force of water can be directed directly to each base 32 of the bristle tufts 18, to properly clean the toothpaste and debris therefrom. The flexible washer 26 is fabricated out of a soft rubber or suitable resilient material to form the seal about the water faucet 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A toothbrush cleaning system for a toothbrush having a handle, a head and a plurality of bristle tufts extending from said head, said cleaning system comprising:

a) said handle and said head having a longitudinal conduit extending therethrough;

b) said handle having a water inlet port fluidly connected to one end of said conduit on an opposite side of said handle from said bristle tufts;

c) said head having a plurality of water outlet ports fluidly connected to an opposite end of said conduit on a same side with said bristle tufts; and d) a resilient washer having a tapered neck which extends into said water inlet port, whereby said washer can be pressed against a water faucet to form a seal thereabout and allow a force of water from said water faucet to enter said water inlet port, travel through said conduit and exit said water outlet ports to clean toothpaste and debris from said bristle tufts.

2. A toothbrush cleaning system for a toothbrush, as recited in claim 1, wherein said water outlet ports are angled towards each base of said bristle tufts where most of said toothpaste and debris accumulate, so that the force of water can be directed directly to each base of said bristle tufts, to properly clean said toothpaste and debris therefrom.

3. A toothbrush cleaning system for a toothbrush, as recited in claim 2, where said flexible washer is fabricated out of a soft rubber material to form the seal about said water faucet.

4. A toothbrush cleaning system for a toothbrush having an elongated thin flat handle having opposite sides, a head and a plurality of bristle tufts extending from said head, said cleaning system comprising:

a) said handle and said head having a longitudinal conduit extending therethrough;

b) said handle having a water inlet port fluidly connected to one end of said conduit on an opposite side of said handle from said bristle tufts;

c) said head having a plurality of water outlet ports fluidly connected to an opposite end of said conduit on a same side with said bristle tufts; and d) a resilient washer of greater diameter than the outlet of a faucet to which it is to be applied having opposite faces, a tapered neck which extends from one of the faces into said water inlet port, so that the other face of said washer can be simply pressed against a water faucet outlet to form a seal therewith and direct a force of water from said water faucet in to said water inlet port, through said conduit and exit said water outlet ports to clean toothpaste and debris from said bristle tufts.

* * * * *